US006006772A

United States Patent [19]

Zheng

[11] Patent Number: 6,006,772

[45] **Date of Patent: *Dec. 28, 1999**

[54] COLLAPSIBLE CONTAINERS

[75] Inventor: Yu Zheng, Covina, Calif.

[73] Assignee: Patent Category Corp., Walnut, Calif.

[ * ] Notice: This patent is subject to a terminal disclaimer.

[21] Appl. No.: 08/995,656

[22] Filed: Dec. 22, 1997

Related U.S. Application Data

[60] Continuation-in-part of application No. 08/859,876, May 21, 1997, Pat. No. 5,816,279, which is a division of application No. 08/627,875, Apr. 3, 1996, Pat. No. 5,664,596, which is a continuation of application No. 08/281,369, Jul. 27, 1994, Pat. No. 5,560,385, which is a continuation-in-part of application No. 08/024,690, Mar. 1, 1993, Pat. No. 5,467,794, which is a continuation-in-part of application No. 07/764,784, Sep. 24, 1991, Pat. No. 5,301,705.

[51] Int. Cl.[6] ..... E04H 15/40

[52] U.S. Cl. ..... 135/126; 135/130; 135/137; 135/117; 135/97

[58] Field of Search ..... 135/125, 126, 135/128, 143, 127, 130, 137, 114, 115, 117, 119, 94, 97

[56] References Cited

U.S. PATENT DOCUMENTS

| | | | |
|---|---|---|---|
| 2,057,942 | 1/1936 | Fay . | |
| 2,879,553 | 3/1959 | Keating | 135/94 X |
| 3,502,091 | 3/1970 | Corbin | 135/97 |
| 3,675,667 | 7/1972 | Miller . | |
| 3,733,758 | 5/1973 | Maier et al. . | |
| 3,807,421 | 4/1974 | Geiger et al. | 135/97 X |
| 3,960,161 | 6/1976 | Norman . | |
| 3,987,580 | 10/1976 | Ausnit . | |
| 3,990,463 | 11/1976 | Norman . | |
| 4,073,105 | 2/1978 | Daugherty . | |
| 4,133,149 | 1/1979 | Angress | 135/97 X |
| 4,170,082 | 10/1979 | Freedman . | |
| 4,212,130 | 7/1980 | Walker . | |
| 4,635,411 | 1/1987 | Kurzen . | |
| 4,825,892 | 5/1989 | Norman . | |
| 4,858,634 | 8/1989 | McLeese . | |
| 4,876,829 | 10/1989 | Mattick | 135/125 X |
| 4,951,333 | 8/1990 | Kaiser et al. . | |
| 5,038,812 | 8/1991 | Norman | 135/126 |
| 5,054,507 | 10/1991 | Sparks . | |
| 5,134,815 | 8/1992 | Pickett . | |
| 5,137,044 | 8/1992 | Brady . | |
| 5,222,513 | 6/1993 | Hilliard | 135/97 |
| 5,301,705 | 4/1994 | Zheng | 135/125 |
| 5,394,897 | 3/1995 | Ritchey et al. | 135/97 X |
| 5,467,794 | 11/1995 | Zheng | 135/125 |
| 5,592,961 | 1/1997 | Chin . | |

FOREIGN PATENT DOCUMENTS

| | | | |
|---|---|---|---|
| 1380738 | 10/1964 | France | 135/97 |
| 2635136 | 1/1990 | France . | |
| 3013178 | 11/1981 | Germany | 135/125 |
| 13675 | 5/1871 | United Kingdom | 135/97 |

*Primary Examiner*—Carl D. Friedman
*Assistant Examiner*—Phi Dieu Tran A
*Attorney, Agent, or Firm*—Raymond Sun

[57] ABSTRACT

Collapsible structures are provided for storing objects. These collapsible structures can be easily and quickly folded and collapsed into a compact configuration. The collapsible structures have at least three foldable frame members, each having a folded and an unfolded orientation. A fabric material substantially covers each frame member to form a panel for each frame member when the frame member is in the unfolded orientation, with the fabric assuming the unfolded orientation of its associated frame member.

11 Claims, 14 Drawing Sheets

COLLAPSIBLE CONTAINERS

This is a continuation-in-part of Ser. No. 08/859,876, entitled "Collapsible Play Structures", filed May 21, 1997, U.S. Pat. No. 5,816,279 which is a division of Ser. No. 08/627,875, filed Apr. 3, 1996, now U.S. Pat. No. 5,664,596, which is a continuation of Ser. No. 08/281,369, filed Jul. 27, 1994, now U.S. Pat. No. 5,560,385, which is a continuation-in-part of Ser. No. 08/024,690, entitled "Collapsible Shade Structure", filed Mar. 1, 1993, now U.S. Pat. No. 5,467,794, which is a continuation-in-part of Ser. No. 07/764,784, entitled "Collapsible Shade Structure", filed Sep. 24, 1991, now U.S. Pat. No. 5,301,705, the entire disclosures of which are incorporated by this reference as though set forth fully herein.

BACKGROUND OF THE INVENTION

1. Related Cases

2. Field of the Invention

The present invention relates to collapsible structures, and in particular, to collapsible play structures and containers which may be provided in a variety of shapes and sizes. The collapsible structures may be twisted and folded to reduce the overall size of the structures to facilitate convenient storage and use.

3. Description of the Prior Art

Two important considerations for all toys or play things targeted for children and adults are convenience and variety. Relating to convenience, a toy must be easily transportable so that the user can move it around the home, or even to other places outside of the home. A toy must also be easily stored since an adult or child is likely to have many other toys or objects that compete for precious storage space in the home. As for variety, a toy must offer enough variety in play so that the child or adult will be able to enjoy it for a long period of time without getting bored.

Larger toys often pose a greater problem with regards to convenience. The larger toys tend to be bulky, which makes it difficult to move them around the home, and sometimes makes it prohibitive to move them outside the house to other locations. Bulky toys also take up much storage space. For these reasons, many executive toys targeted for adults are made in small sizes.

Collapsible play structures have recently become popular with both adults and children. Examples of such structures are shown and described in U.S. Pat. Nos. 5,038,812 (Norman), 5,467,794 (Zheng) and 5,560,385 (Zheng), the latter two being issued to the present inventor. These structures may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

However, these collapsible structures have been primarily used to shelter individuals, animals, and objects, and to allow individuals or animals to crawl therethrough. The present invention provides different applications for these collapsible structures, thereby increasing the variety of play, entertainment value, and utility for such structures.

SUMMARY OF THE DISCLOSURE

The present invention provides a collapsible structure that provides storage for a wide variety of items, and when in use also provides entertainment to both adults and children. These collapsible structures can be easily and quickly folded and collapsed into a compact configuration. As a result, the collapsible structures according to the present invention are convenient to use, to move around, and to store, thereby making them ideal for use at many different locations.

In order to accomplish the objects of the present invention, the collapsible structure according to the present invention has at least three foldable frame members, each having a folded and an unfolded orientation. A fabric material substantially covers each frame member to form a panel for each frame member when the frame member is in the unfolded orientation, with the fabric assuming the unfolded orientation of its associated frame member. A top fabric is connected to the panels and extends therebetween, the top fabric having an opening communicating with the enclosed space that is formed by the panels.

In accordance with one aspect of the present invention, the structure further includes a bottom panel connected to the bottom edges of the panels and extending therebetween. The bottom fabric further includes an opening, and a drawstring for adjusting the size of the opening of the bottom fabric.

In accordance with another aspect of the present invention, each panel is devoid of any openings so that the structure can operate as a container for objects. In this regard, the opening in the top fabric is sized and configured to allow objects, such as balls, clothing items, and waste paper, among others, to pass therethrough.

In accordance with yet another aspect of the present invention, a guide is connected to the opening in the top fabric and extends into the enclosed space.

When the collapsible structures are to be folded and collapsed for storage, the panels and their corresponding frame members may be folded against each other about the hinged connections to have the panels and frame members overlying each other. The overlying panels and frame members are then collapsed by twisting and folding to form a plurality of concentric frame members and panels to substantially reduce the size of the structure.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The collapsible structures according to the present invention are provided in the form of play structures and containers which can be enjoyed by both children and adults. These structures can be folded and collapsed into a compact configuration for convenient storage and transportation.

Figure 1:
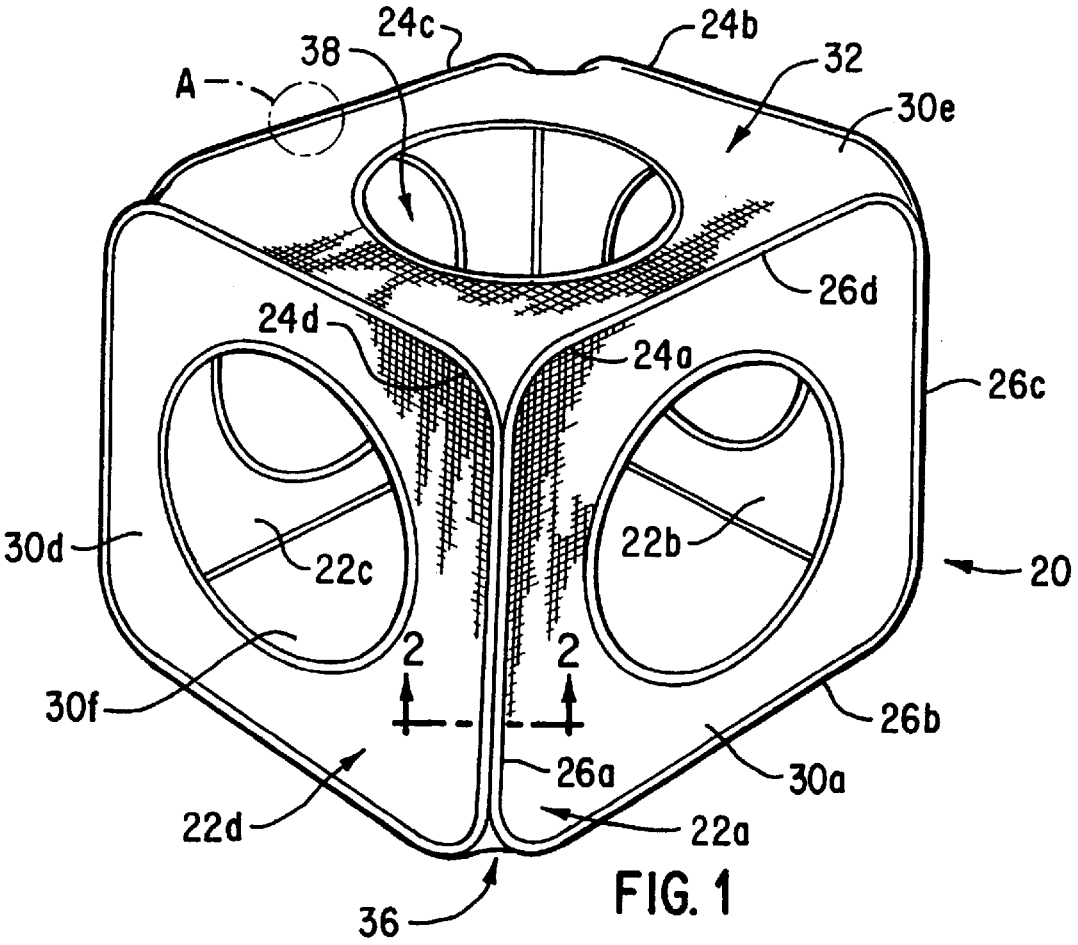
FIG. 1 is a perspective view of one module of a collapsible structure according to a first preferred embodiment of the present invention.
Figure 1A:
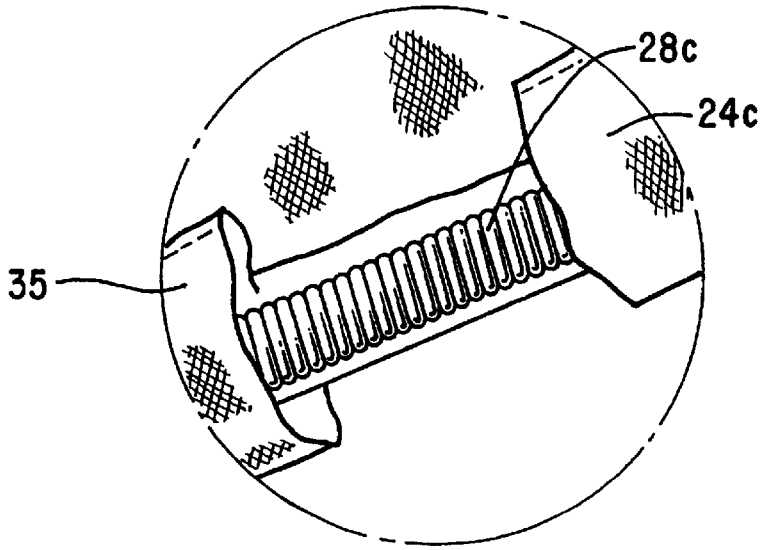
FIG. 1A is a partial cut-away view of the section A of the structure of FIG. 1 illustrating a frame member retained within a sleeve.

As shown in FIGS. 1 and 1A, the basic component for a collapsible structure according to the present invention comprises a module 20. As explained in greater detail hereinbelow, the collapsible structures according to the present invention are each comprised of one or more of these modules 20 assembled to create a resulting structure having the desired shape and size.

Referring to FIG. 1, according to a first preferred embodiment of the present invention, each module 20 has four side panels 22*a*, 22*b*, 22*c* and 22*d* connected to each other to encircle an enclosed space. Each side panel 22*a*, 22*b*, 22*c* and 22*d* has four sides, a left side 26*a*, a bottom side 26*b*, a right side 26*c* and a top side 26*d*. Each side panel 22*a*, 22*b*, 22*c* and 22*d* has a continuous frame retaining sleeve 24*a*, 24*b*, 24*c* or 24*d* provided along and traversing the four edges of its four sides 26*a*, 26*b*, 26*c* and 26*d*. A continuous frame member 28*a*, 28*b*, 28*c* or 28*d* is retained or held within each frame retaining sleeve 24*a*, 24*b*, 24*c* or 24*d*, respectively, to support each side panel 22*a*, 22*b*, 22*c* and 22*d*. Only the frame member 28*c* is shown in FIG. 1A; the other frame members 28*a*, 28*b* and 28*d* are not shown but are the same as frame member 28*c*.

The continuous frame members 28*a*, 28*b*, 28*c* and 28*d* may be provided as one continuous loop, or may comprise a strip of material connected at both ends to form a continuous loop. The continuous frame members 28*a*, 28*b*, 28*c* and 28*d* are preferably formed of flexible coilable steel, although other materials such as plastics may also be used. The frame members should be made of a material which is relatively strong and yet is flexible to a sufficient degree to allow it to be coiled. Thus, each frame member 28*a*, 28*b*, 28*c* and 28*d* is capable of assuming two positions or orientations, an open or expanded position such as shown in FIG. 1, or a folded position in which the frame member is collapsed into a size which is much smaller than its open position (see FIG. 8E).

Fabric or sheet material 30*a*, 30*b*, 30*c* and 30*d* extends across each side panel 22*a*, 22*b*, 22*c* and 22*d*, respectively, and is held taut by the respective frame members 28*a*, 28*b*, 28*c* and 28*d* when in its open position. The term fabric is to be given its broadest meaning and should be made from strong, lightweight materials and may include woven fabrics, sheet fabrics or even films. The fabric should be water-resistant and durable to withstand the wear and tear associated with rough treatment by children. The frame members 28*a*, 28*b*, 28*c* and 28*d* may be merely retained within the respective frame retaining sleeves 24*a*, 24*b*, 24*c* and 24*c* without being connected thereto. Alternatively, the frame retaining sleeves 24*a*, 24*b*, 24*c* and 24*d* may be mechanically fastened, stitched, fused, or glued to the frame members 28*a*, 28*b*, 28*c* and 28*d*, respectively, to retain them in position.

Figure 2A:
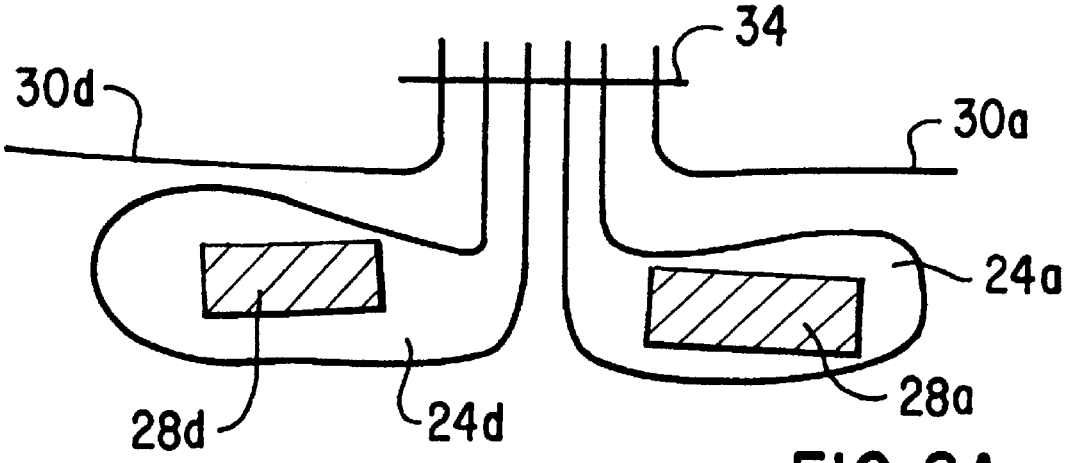
FIG. 2A is a cross-sectional view of a first preferred connection between two adjacent panels of the structure of FIG. 1 taken along line 2—2 thereof.

FIG. 2A illustrates one preferred connection for connecting adjacent edges of two side panels 22*a* and 22*d*. The fabric pieces 30*a* and 30*d* are stitched at their edges by a stitching 34 to the respective sleeves 24*a* and 24*d*. Each sleeve 24*a* and 24*d* may be formed by folding a piece of fabric. The stitching 34 also acts as a hinge for the side panels 22*a* and 22*d* to be folded upon each other, as explained below. The connections for the three other pairs of adjacent edges may be identical. Thus, the connections on the left side 26*a* and the right side 26*c* of each side panel 22*a*, 22*b*, 22*c* and 22*d* act as hinge connections for connecting an adjacent side panel.

At the top side 26*d* and the bottom side 26*b* of each side panel 22*a*, 22*b*, 22*c* and 22*d*, where there is no hinge connection to an adjacent side panel, the frame retaining sleeve 24*a*, 24*b*, 24*c* or 24*b* may be formed by merely folding over the corresponding fabric piece and applying a stitching 35 (see FIG. 1A). The fabric piece for the corresponding side panel may then be stitched to the sleeve.

Figure 2B:
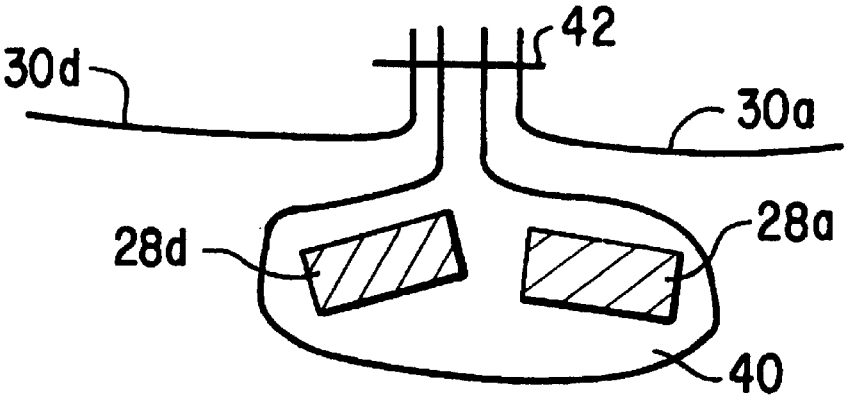
FIG. 2B is a cross-sectional view of a second preferred connection between two adjacent panels of the structure of FIG. 1 taken along line 2—2 thereof.

FIG. 2B illustrates a second preferred connection for connecting adjacent edges of two side panels 22*a* and 22*d*. As in the connection of FIG. 2A, the fabric pieces 30*a* and 30*d* are folded over at their edges at bottom side 26*b* and top side 26*d* to define the respective sleeves 24*a* and 24*d*. However, the frame retaining sleeves 24*a* and 24*d* converge at, or are connected to, one sleeve portion which interconnects side panels 22*a* and 22*d* to form a singular frame retaining sleeve 40 which retains the frame members 28*a* and 28*d*. Sleeve 40 may be formed by providing a tubular fabric, or by folding a piece of fabric, and applying a stitching 42 to its edges to connect the sleeve 40 to the fabric pieces 30*a* and 30*d*. Stitching 42 acts as a hinge for the side panels 22*a* and 22*d*. The connections for the three other pairs of adjacent edges may be identical.

An upper panel 32 comprised of fabric 30*e* may also be connected to the upper edge 26*d* of each side panel 22*a*, 22*b*, 22*c* and 22*d*. Likewise, a lower panel 36 comprised of fabric 30*f* may also be connected to the bottom edge 26*b* of each side panel 22*a*, 22*b*, 22*c* and 22*d*. The upper panel 32 and the lower panel 36 are preferably made of the same type of fabric as the side panels 22*a*, 22*b*, 22*c* and 22*d*. Each module 20 preferably comprises at least the four side panels 22*a*, 22*b*, 22*c* and 22*d*, with the upper and lower panels 32 and 36 being optional.

Openings 38 may be provided in some or all of the panels 22*a*, 22*b*, 22*c*, 22*d*, 32 and 36. These openings 38 may be of any shape (e.g., triangular, circular, rectangular, square, diamond, etc.) and size and are designed to allow an individual to crawl through them to enter or to exit the module 20. While the module 20 of FIG. 1 is shown and described as having four side panels, each having four sides, it will be appreciated that a module may be made of any number of side panels, each having any number of sides, without departing from the spirit and scope of the present invention. For example, each module may have three or more side panels, and each side panel may have three or more sides. Thus, the module of the present invention may take a variety of external shapes. However, each side panel of the module, regardless of its shape, is supported by at least one continuous frame member.

Figure 8A:
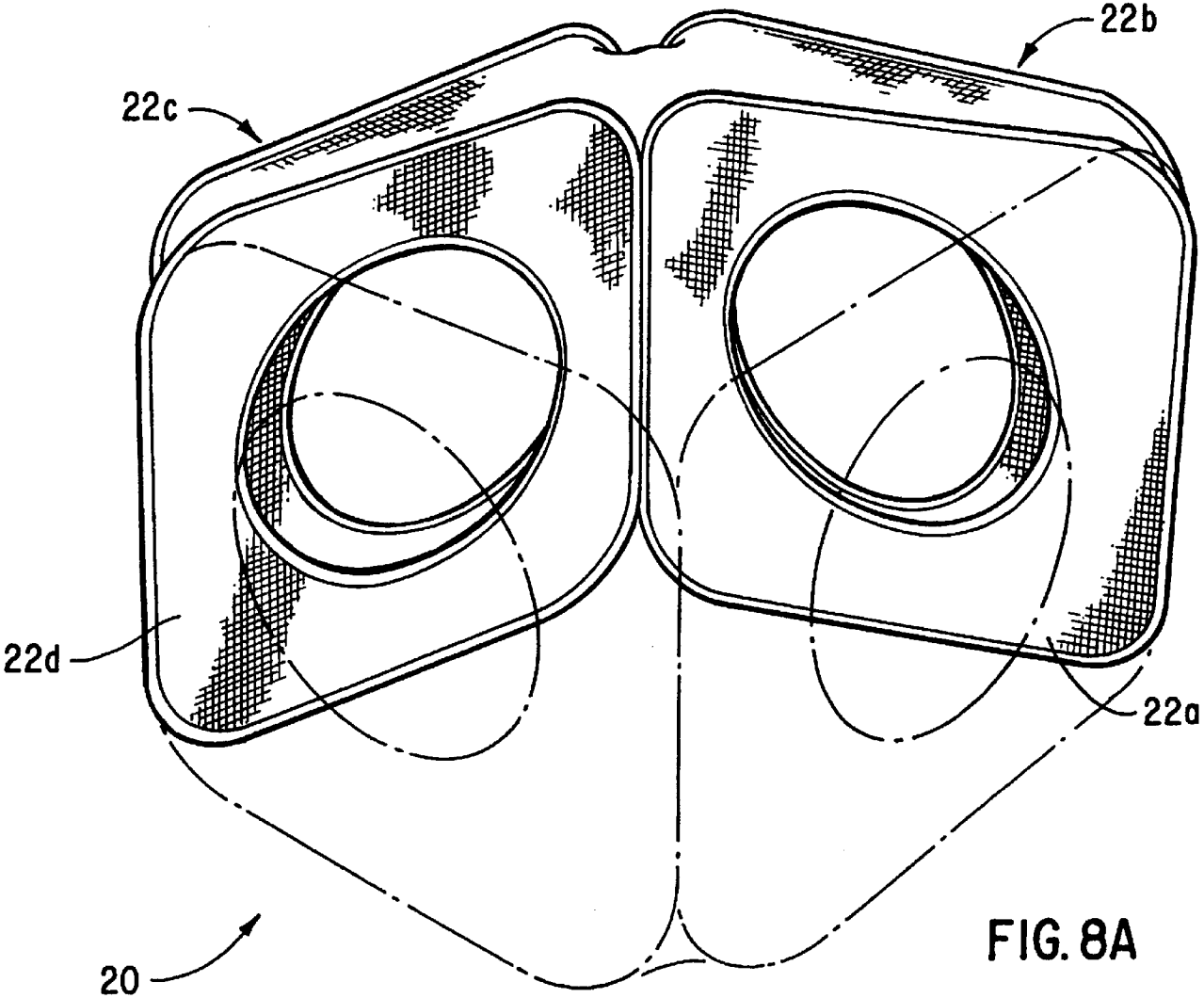
FIGS. 8(A) through 8(E) illustrate how the collapsible structure of FIG. 1 may be twisted and folded for compact storage.
Figure 8B:
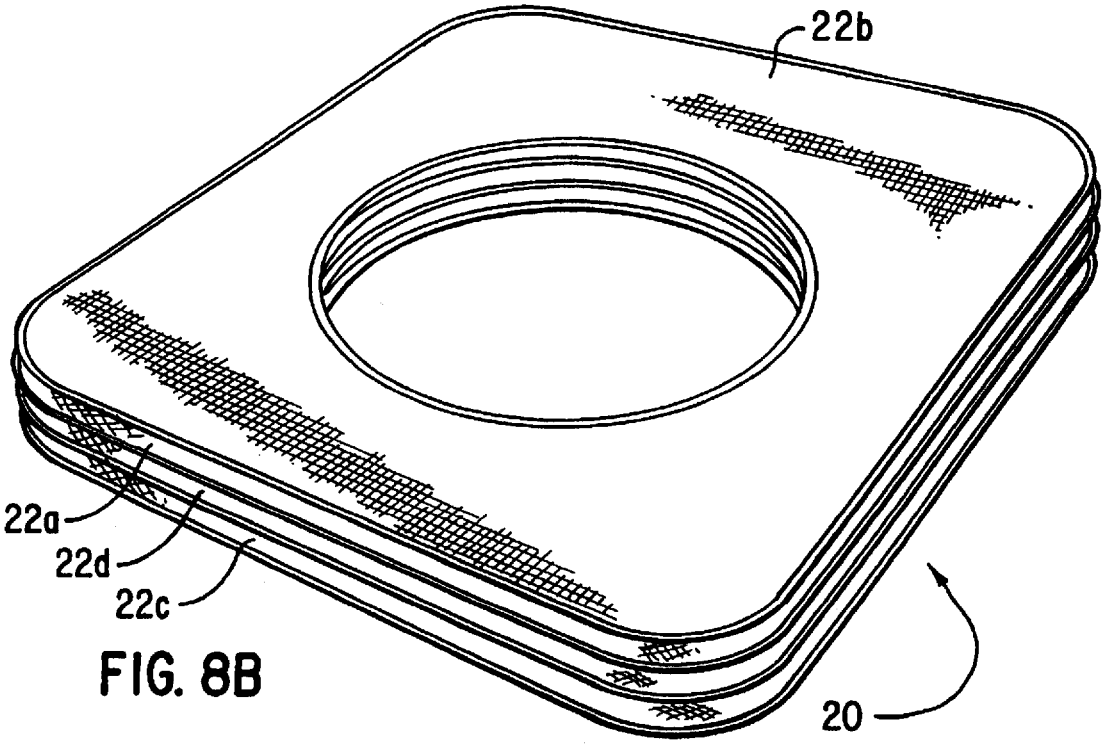
Figure 8C:
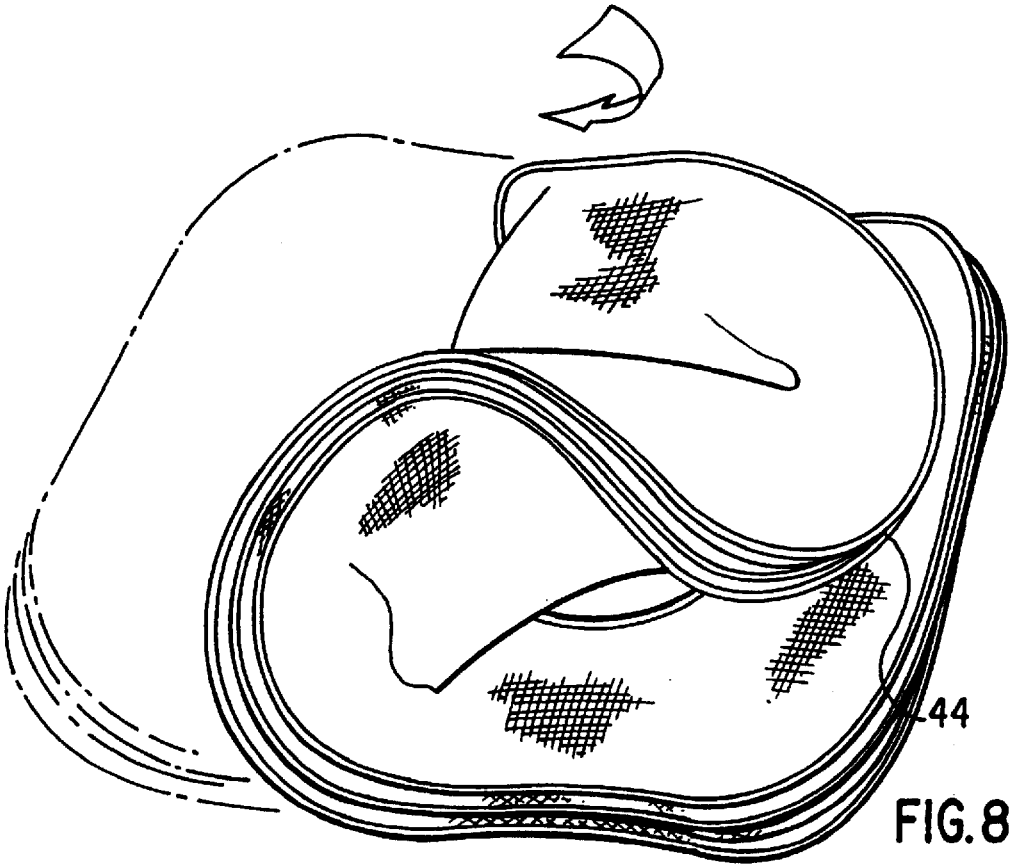
Figure 8D:
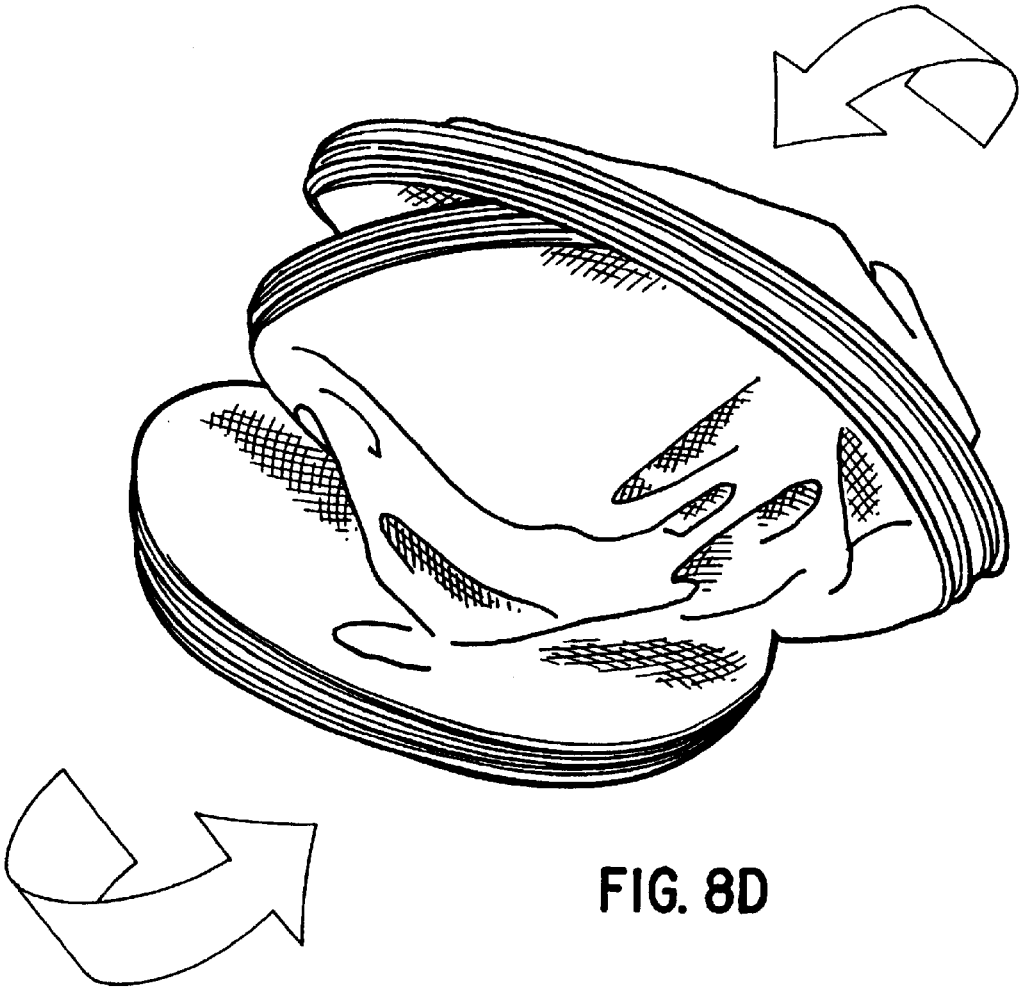
Figure 8E:
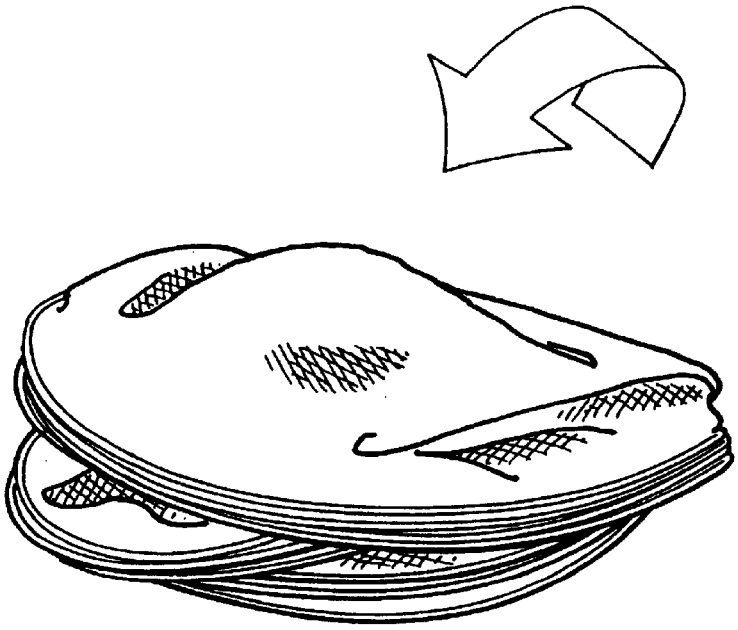

FIGS. 8A through 8E describe the various steps for folding and collapsing the structure or module 20 of FIG. 1 for storage. In FIG. 8A, the first step consists of pushing in side panels 22*a* and 22*d* such that side panel 22*d* collapses upon side panel 22*c* and side panel 22*a* collapses upon side panel 22*b*. Then, in the second step shown in FIG. 8B, the two side panels 22*a* and 22*b* are folded so as to be collapsed upon the two side panels 22*c* and 22*d*. The structure is then twisted and folded to collapse the frame members and side panels into a smaller shape. In the third step shown in FIG. 8C, the opposite border 44 of the structure is folded in upon the previous fold to further collapse the frame members with the side panels. As shown in FIG. 8D, the fourth step is to continue the collapsing so that the initial size of the structure is reduced. FIG. 8E shows the fifth step with the frame members and side panels collapsed on each other to provide for a small essentially compact configuration having a plurality of concentric frame members and layers of the side panels so that the collapsed structure has a size which is a fraction of the size of the initial structure.

Figure 3:
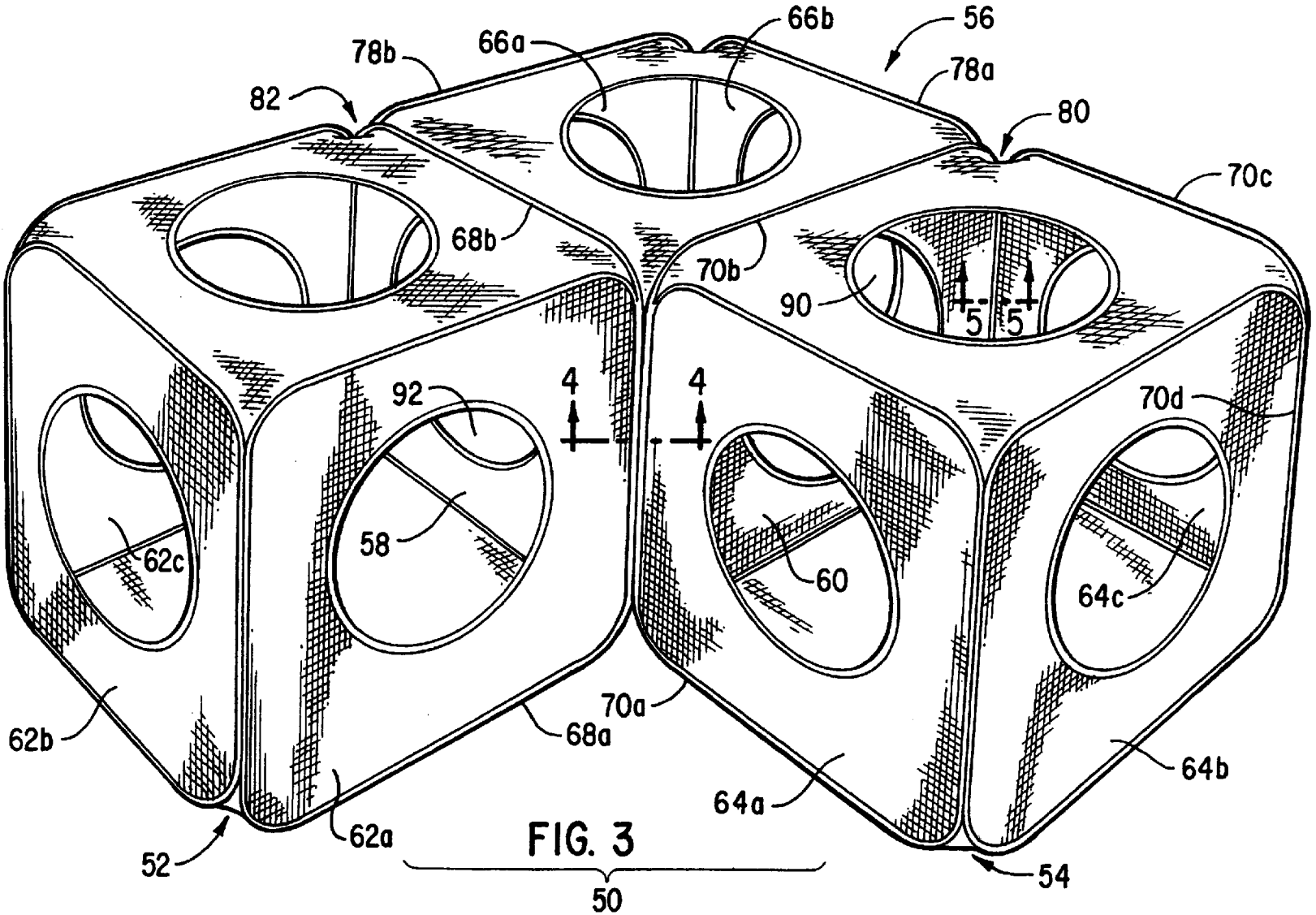
FIG. 3 is a perspective view of a collapsible structure according to a second preferred embodiment of the present invention comprising three modules.

A second preferred embodiment of the present invention is shown in FIG. 3. A structure 50 comprises three modules 52, 54 and 56 provided in an attached manner. Each module 52, 54 and 56 is essentially of the same construction as module 20, except that modules 52 and 56 share a common side panel 58, and modules 54 and 56 share a common side panel 60. The connections between adjacent side panels (i.e., the two side panel connections) may be the same as any of those illustrated in FIGS. 2A and 2B above.

Figure 4B:
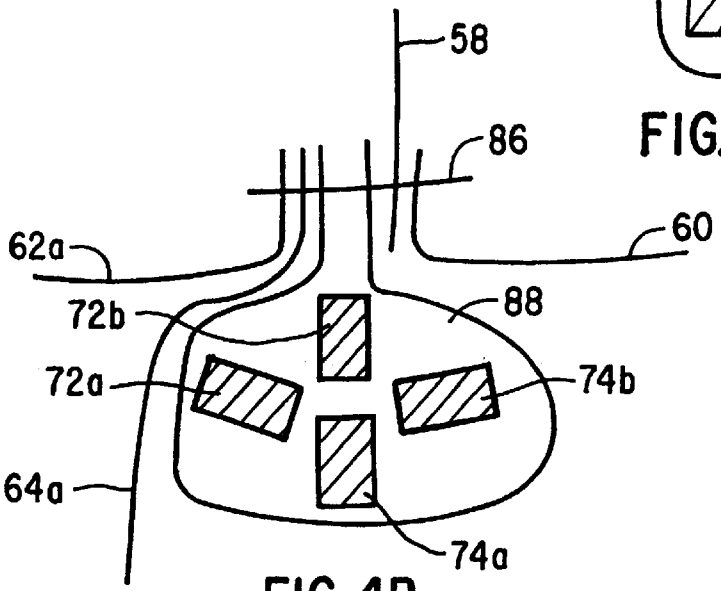
FIG. 4B is a cross-sectional view of a second preferred connection between the four adjacent panels of the structure of FIG. 3 taken along line 4—4 thereof.
Figure 4A:
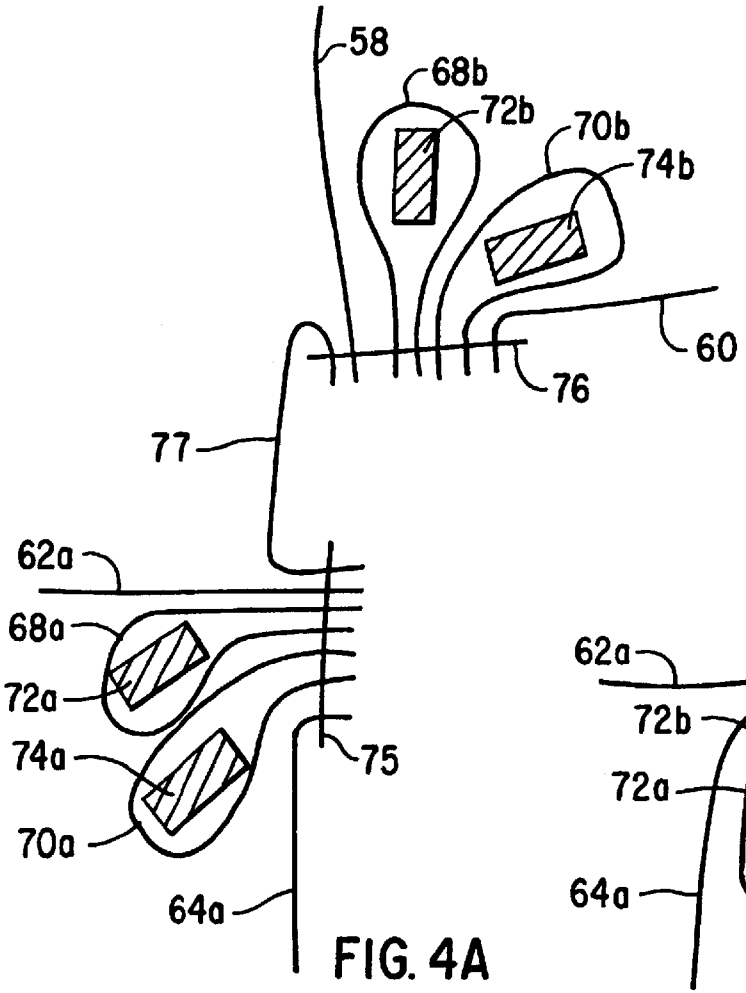
FIG. 4A is a cross-sectional view of a first preferred connection between the four adjacent panels of the structure of FIG. 3 taken along line 4—4 thereof.

FIG. 4A illustrates a preferred four side panel connection along line 4—4 of FIG. 3, in which the four frame retaining sleeves 68*a*, 68*b*, 70*a* and 70*b* each retain a frame member 72*a*, 72*b*, 74*a* and 74*b*, respectively. Sleeves 68*a* and 70*a*, and side panels 62*a* and 64*a*, are connected by a stitching 75 and sleeves 68*b* and 70*b*, and side panels 58 and 60, are connected by a stitching 76. Each of the stitchings 75 and 76 also connect an interconnecting hinge fabric 77 which holds the two pairs of sleeves 68*a*, 70*a* and 68*b*, 70*b* together, and acts to hinge these two pairs of sleeves.

Alternatively, FIG. 4B illustrates a second preferred connection in which the four frame retaining sleeves 68*a*, 68*b*, 70*a* and 70*b*, each formed by a separate stitching, converge to form, or are connected to, one singular frame retaining sleeve 88 which retains the frame members 72*a*, 72*b*, 74*a* and 74*b*. The singular frame retaining sleeve 88 is created by folding a fabric material, or providing a tubular fabric, and applying a stitching 86 to connect the sleeve 88 to the side panels 58, 60, 62*a* and 64*a*. Stitching 86 acts as a hinge for the side panels 58, 60, 62*a* and 64*a*.

Figure 4C:
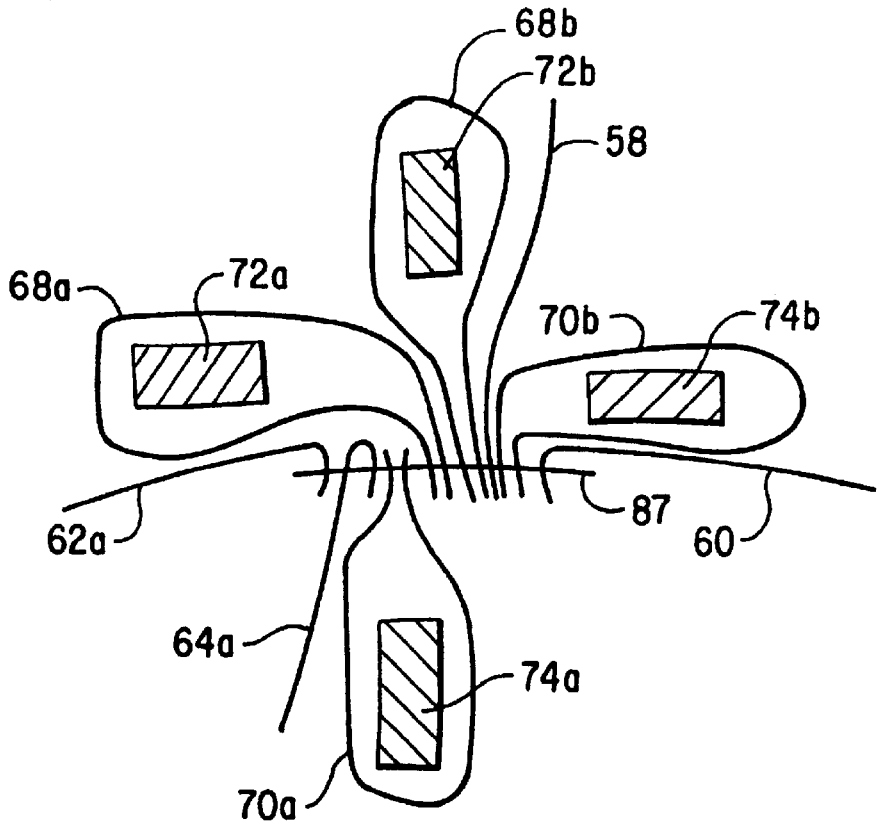
FIG. 4C is a cross-sectional view of a third preferred connection between the four adjacent panels of the structure of FIG. 3 taken along line 4—4 thereof.
Figure 4D:
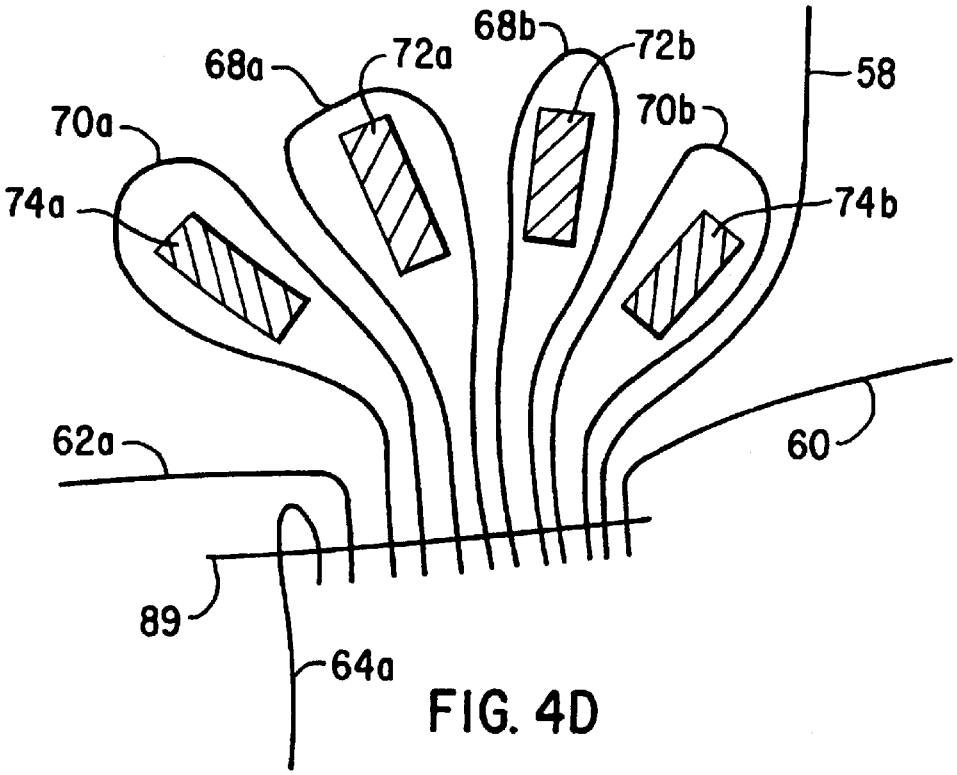
FIG. 4D is a cross-sectional view of a fourth preferred connection between the four adjacent panels of the structure of FIG. 3 taken along line 4—4 thereof.

FIGS. 4C and 4D illustrate third and fourth preferred connections in which the four frame retaining sleeves 68*a*, 68*b*, 70*a* and 70*b* each retain a frame member 72*a*, 72*b*, 74*a* and 74*b*, respectively, and are stitched together with the fabric pieces of the side panels 62*a*, 64*a*, 58 and 60 by stitching 87 (FIG. 4C) and stitching 89 (FIG. 4D). The stitchings 87 and 89 also act to hinge the side panels 58, 60, 62*a* and 64*a*.

Figure 5B:
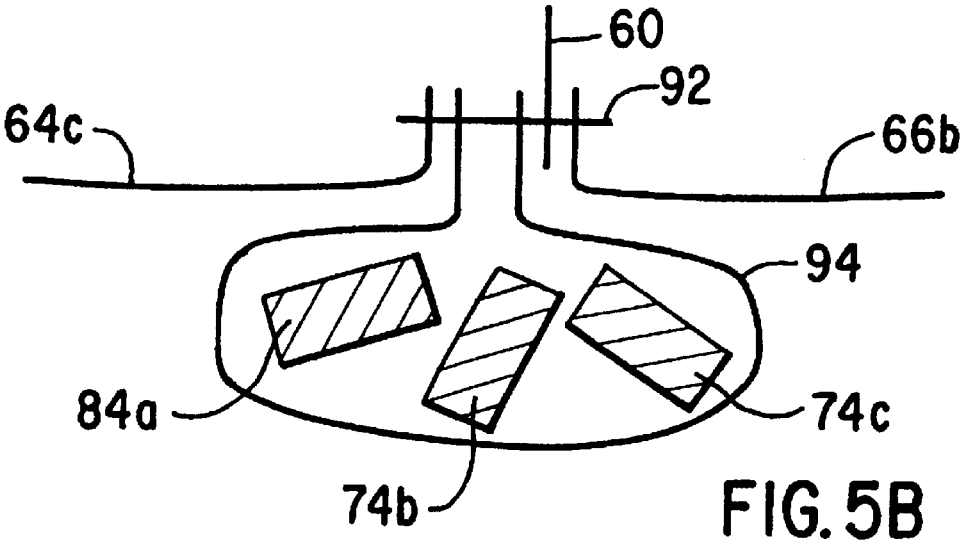
FIG. 5B is a cross-sectional view of a second preferred connection between the three adjacent panels of the structure of FIG. 3 taken along line 5—5 thereof.
Figure 5A:
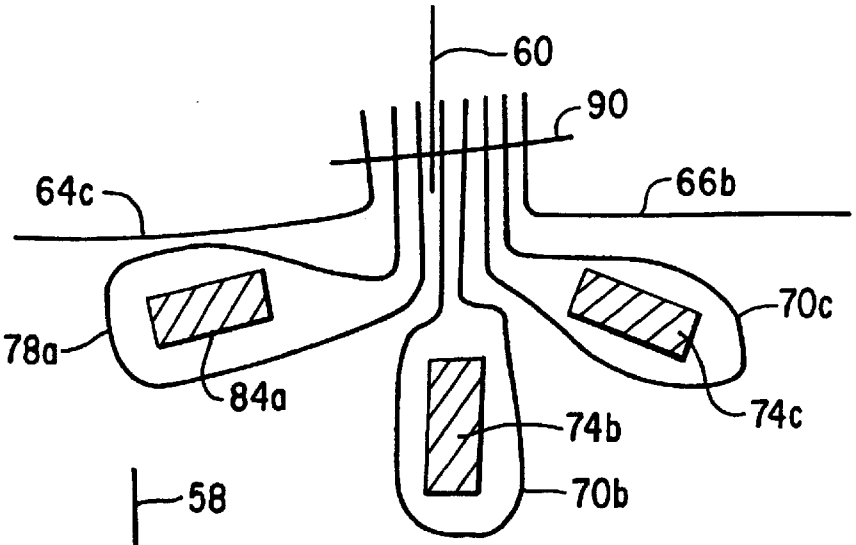
FIG. 5A is a cross-sectional view of a first preferred connection between the three adjacent panels of the structure of FIG. 3 taken along line 5—5 thereof.

FIG. 5A illustrates a preferred connection for the three side panel connection 80 along line 5—5 of FIG. 3, in which the three frame retaining sleeves 70*b*, 70*c* and 78*a* each retain a frame member 74*b*, 74*c* and 84*a*, respectively, and are held together by stitching 90. The fabric pieces of side panels 60, 64*c* and 66*b* are also stitched to the sleeves 70*b*, 70*c* and 78*a* by the stitching 90. Alternatively, FIG. 5B illustrates a second preferred connection in which the three frame retaining sleeves 70*b*, 70*c* and 78*a*, each formed by a separate stitching, converge to form, or are connected to, one singular frame retaining sleeve 94 which retains the frame members 74*b*, 74*c* and 84*a*. The singular frame retaining sleeve 94 is created by folding a fabric material and applying a stitching 92 to hold the sleeve 94 together with the side panels 60, 64*c* and 66*b*. The stitchings 90 and 92 act as hinges for the side panels 60, 64*c* and 66*b*. The three side panel connection 82 is identical to the three side panel connection 80 and is not further discussed herein.

To fold and collapse the structure 50, the side panels 62*a* and 62*b* of module 52 are pushed onto side panels 58 and 62*c*, respectively, the side panels 64*a* and 64*b* of module 54 are pushed onto side panels 60 and 64*c*, respectively, and the side panels 66*a* and 66*b* of module 56 are pushed onto side panels 58 and 60, respectively. Thereafter, combined side panels 62*b* and 62*c* are folded over to be collapsed upon the combined side panels 62*a* and 58, and combined side panels 64*b* and 64*c* are folded over to be collapsed upon the combined side panels 64*a* and 60. The combined side panels 66*b*, 60, 64*a*, 64*b* and 64*c* are then folded over and collapsed upon the combined side panels 66*a*, 58, 62*a*, 62*b* and 62*c*, thereby creating a stack of ten side panels. The combined stack of ten side panels may then be twisted and folded in the manner described above in connection with FIGS. 8C–8E.

Alternatively, the three modules 52, 54 and 56 of structure 50 may be provided as three separate modules, each having four side panels. Each such module could be identical to module 20 of FIG. 1. The three separate modules may be connected by conventional attachment methods such as velcro, hooks, loops, fasteners or others, to create the structure 50, or another structure with a different shape. For example, an individual may choose to create a structure having three modules 52, 54 and 56 arranged in a linear manner. The attachment method allows for convenient attachment and detachment. Each module may be folded and collapsed in the manner described in FIGS. 8A–8E.

Regardless of whether the modules 52, 54 and 56 are provided separately or as an attached structure, the entire structure 50 may be conveniently folded and collapsed, thereby making it convenient to move around, and requiring little storage space. If the modules 52, 54 and 56 are provided separately, the individual further derives an additional variety of play since he or she can create play structures of different shapes. Additionally, an individual may derive amusement by attempting to align the openings 90 and 92 in the interfacing side panels so that he or she can crawl from one module into another.

Although the structure 50 is shown as having three modules 52, 54 and 56, each being of the same size and shape, it will be appreciated that the present invention encompasses within its scope structures having any number of modules, each having any number of different sizes and shapes and being made from side panels having any number of different sizes and shapes.

Figure 6:
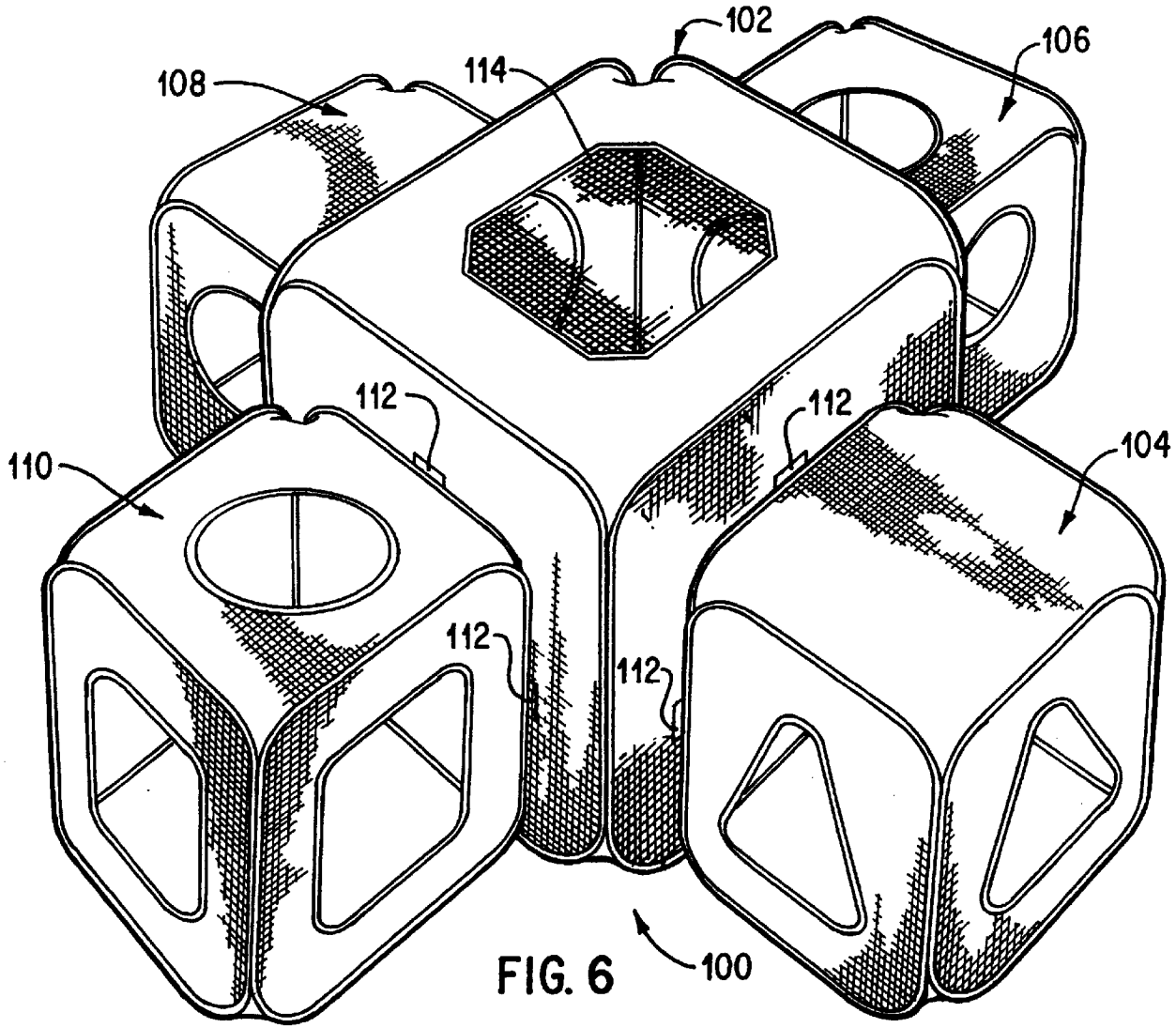
FIG. 6 is a perspective view of a collapsible structure according to a third preferred embodiment of the present invention comprising four modules connected to the different side panels of one large module.

An example is illustrated in the third preferred embodiment of FIG. 6. The structure 100 comprises a large module 102, and four identical but smaller modules 104, 106, 108 and 110, each connected to one of the four side panels of the large module 102 by a conventional attachment method, for example, velcro 112. A mesh 114 may be provided to cover an opening in the large module 102. The openings in the modules 102, 104, 106, 108 and 110 may be provided in varying shapes and sizes. Although the structure 100 is shown as having four identical modules 104, 106, 108 and 110, these four modules may be provided in different shapes and sizes.

The separate modules according to the present invention may be provided or purchased on an individual basis, in different shapes and sizes, so that an individual may be able to create a structure of a desired shape and size. Alternatively, a specific number of differently shaped and sized modules may be packaged and sold together. In either case, the individual will have the opportunity to create an endless variety of structures at his or her disposal, thereby enhancing the amusement value of the modules, and stimulating creativity by challenging the individual to create as many different structures as possible.

Figure 7:
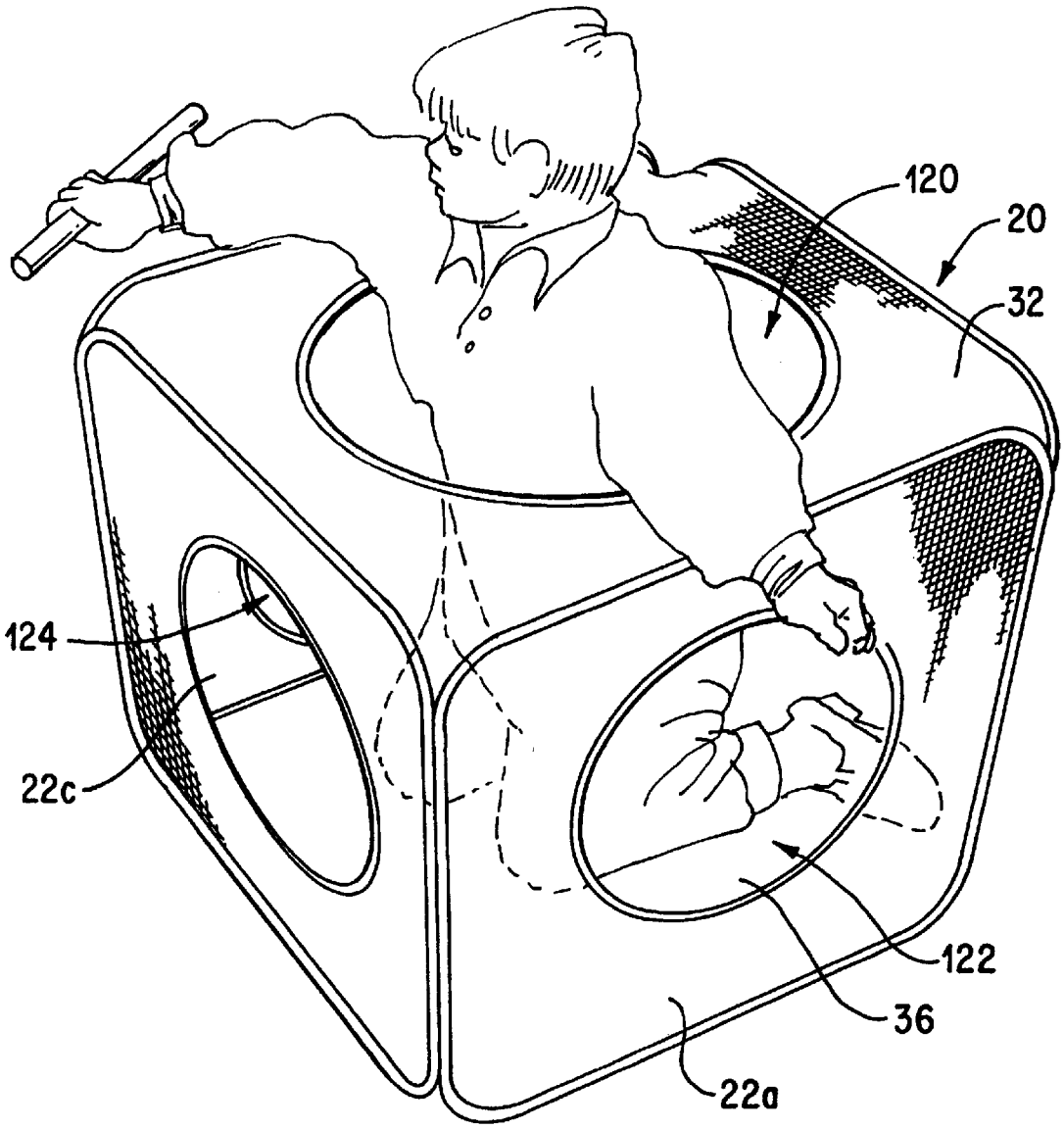
FIG. 7 is a perspective view of the collapsible structure of FIG. 1 which may be sized to allow a child to wear the structure as part of a costume.

FIG. 7 illustrates an additional application for the module 20. The module 20 may be sized such that it may be fitted around the body of a child, to act as part of a costume. The module 20 may then be able to support other bulky costumes, and would be especially useful for occasions such as halloween. For example, the child's head and arms could extend through opening 120 in the upper panel 32 and his legs could extend through an opening (not shown) in the lower panel 36. Alternatively, the module 20 could be sized small enough so that the child's arms could extend through the openings 122 and 124 in the side panels **22*a* and 22*c*, respectively. Further, the lower panel 36** could be omitted if desired.

Figure 9:
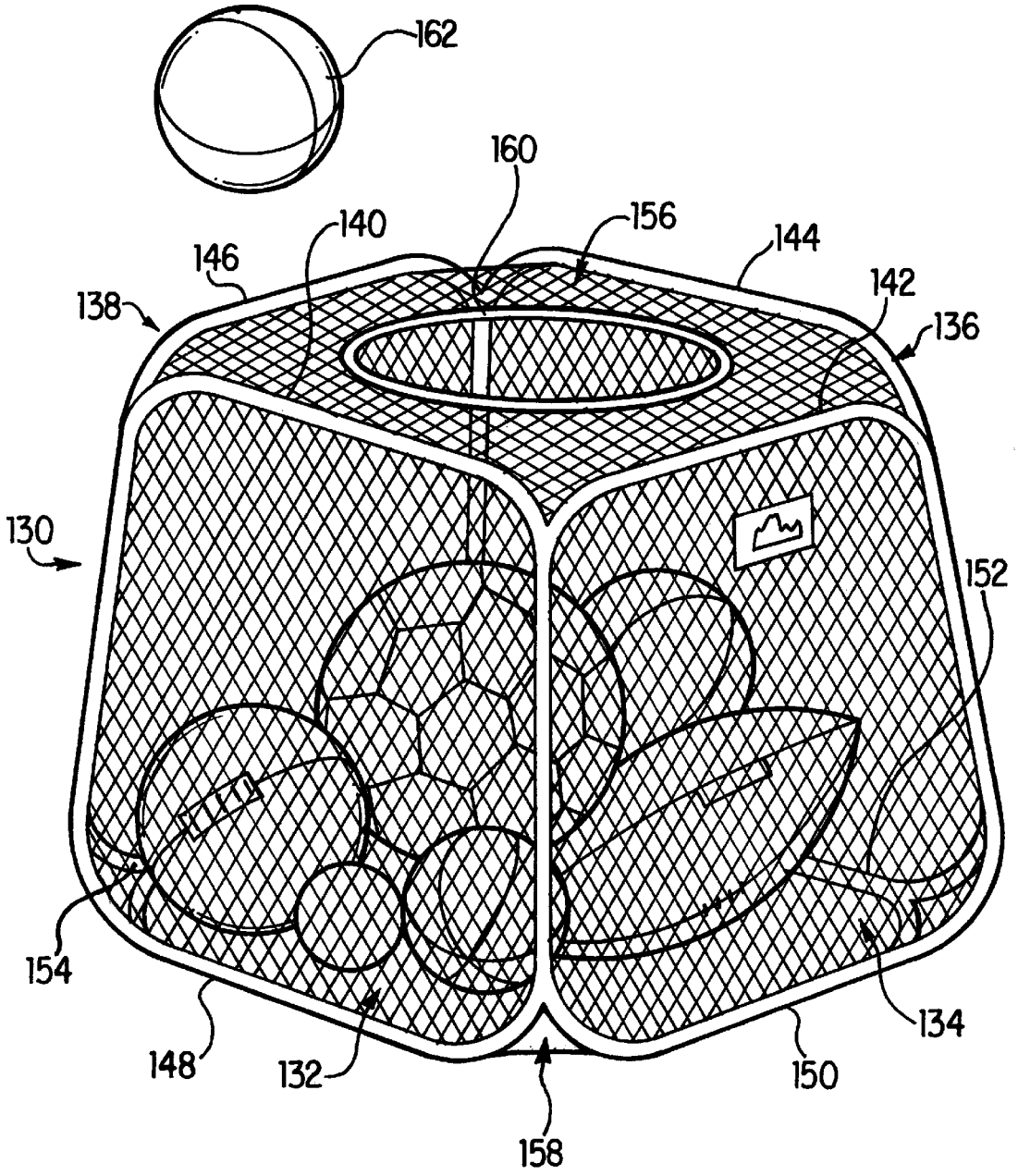
FIG. 9 is a perspective view of a collapsible structure according to a fourth preferred embodiment of the present invention.
Figure 10:
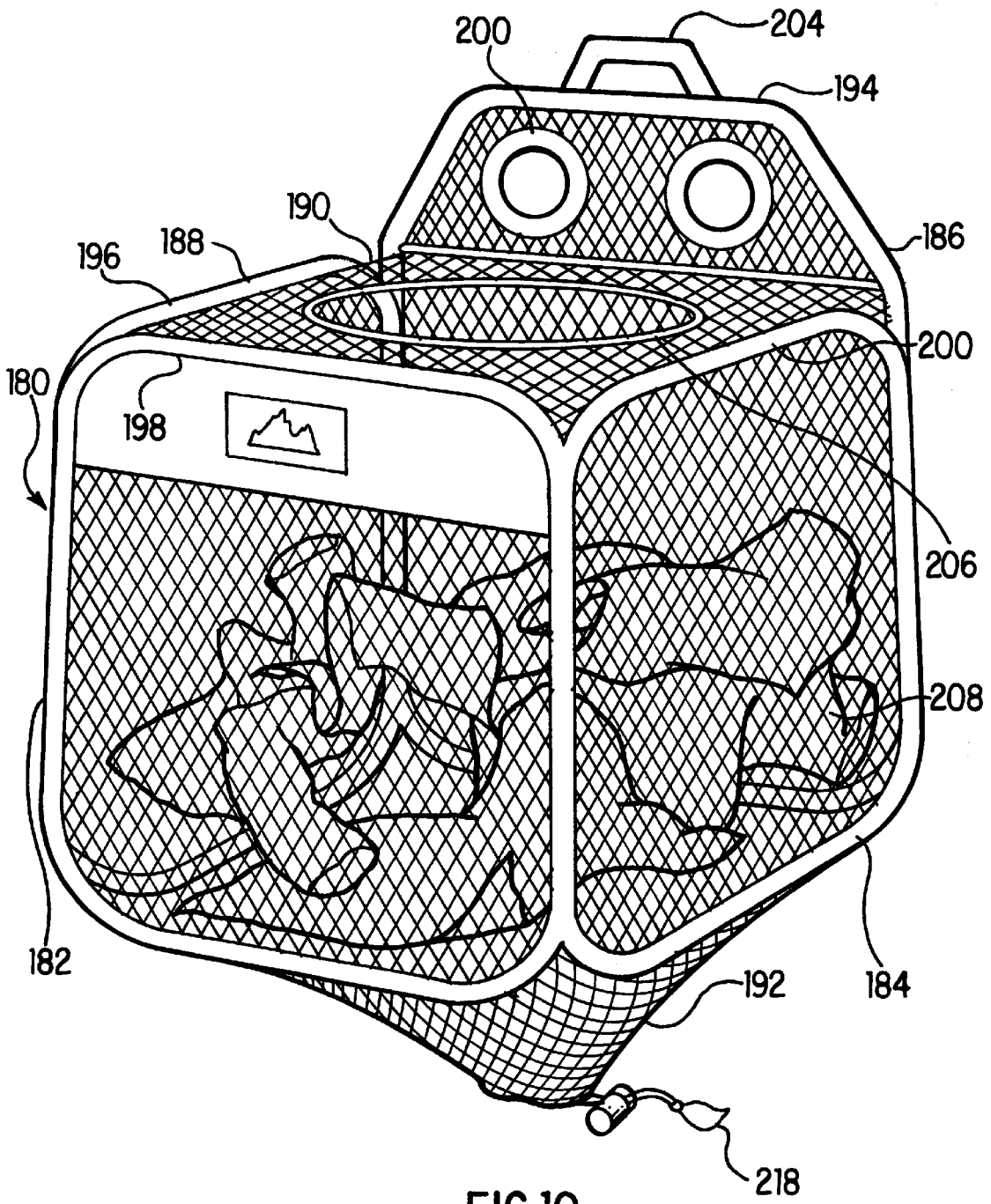
FIG. 10 is a perspective view of a collapsible structure according to a fifth preferred embodiment of the present invention.
Figure 11:
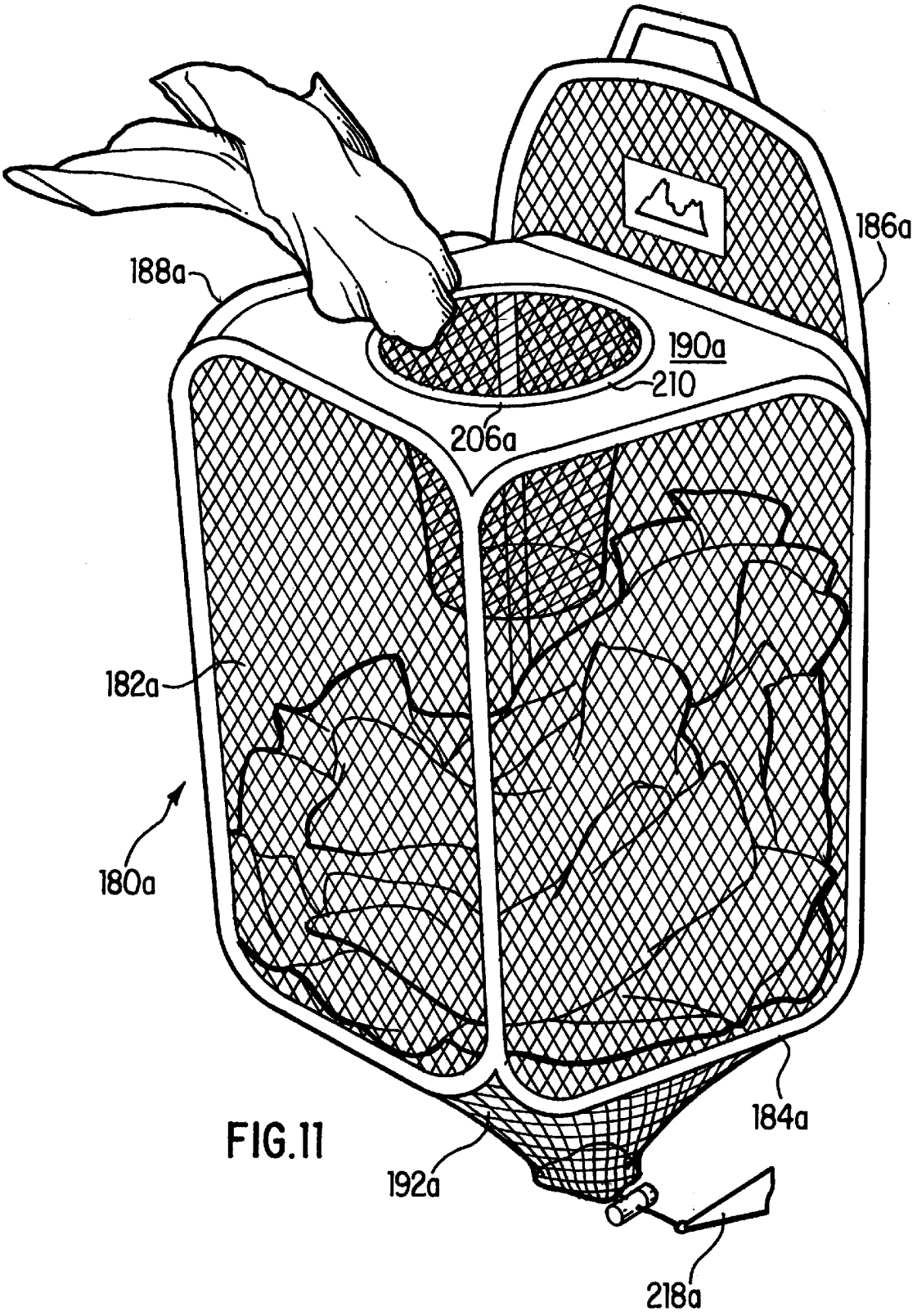
FIG. 11 is a perspective view of a collapsible structure according to a sixth preferred embodiment of the present invention.

Referring now to FIGS. 9–11, each module or collapsible structure of the present invention can be further modified for use as collapsible containers. These collapsible containers can be used by adults and children for holding or storing a variety of objects, and can provide significant entertainment value in the manner in which they can be used.

In FIG. 9, the collapsible module of the present invention has been modified for use in storing athletic equipment, and in particular balls. The structure 130 in FIG. 9 is similar to structure 20, and has four panels 132, 134, 136 and 138. Panels 132, 134, 136 and 138 have essentially the same structure and construction, and are hingedly connected to each other in the same manner, as the side panels **22*a*, 22*b*, 22*c* and 22*d* of structure 20. As with structure 20, an upper fabric 156 is connected to the upper edges 140, 142, 144, 146 of each panel 132, 134, 136, 138, respectively, and a lower fabric 158 is also connected to the bottom edges 148, 150, 152, 154 of the panels 132, 134, 136 and 138, respectively, and acts as a bottom surface. However, to further illustrate that the panels can be provided in different shapes and sizes, the top edges 140, 142, 144, 146 of the panels 132, 134, 136 and 138, respectively, are slightly shorter than the bottom edges 148, 150, 152, 154 of the panels 132, 134, 136 and 138, respectively. As a result, the lower fabric 158 is slightly larger than the upper fabric 156 as the panels 132, 134, 136 and 138** converge slightly from the bottom to the top.

The panels 132, 134, 136, 138, and the fabrics 156, 158 are preferably provided in a mesh material so that the interior of the structure 130 can be viewed from the outside. The side panels 132, 134, 136, 138 and the lower fabric 158 preferably do not have any openings, while one or more openings 160 is provided in the upper fabric 156. The opening 160 provides access to the interior of the structure 130.

The structure 130 can be used to store athletic balls 162. These balls 162 can be placed through the opening 160 and stored in the interior of the structure 130. Alternatively, balls 162 can be tossed from a distance at the opening 160. This enhances the entertainment value of the structure 130 by allowing the individual to aim a ball 162 at the opening 160 and to practice the accuracy of the toss. In this regard, the opening 160 is preferably large enough to allow a user to reach inside the interior of the structure 130 to select and retrieve specific balls 162.

The structure 130 can be used conveniently by athletes to store and transport a large number of balls 162. For example, a tennis player can use the structure 130 to store a large number of tennis balls, and a soccer, basketball or football coach can store several balls in the structure 130. The structure 130 can then be conveniently carried by the athlete or coach to the training ground or facility where the balls 162 are used. When not in use, the structure 130 can be folded and collapsed in the manner described in FIGS. 8A–8E to reduce its size for storage.

In FIG. 10, the collapsible module of the present invention has been modified for use in storing objects, such as clothing items. The structure 180 in FIG. 9 is similar to structure 20, and has four panels 182, 184, 186 and 188. Panels 182, 184, 186 and 188 have essentially the same structure and construction, and are hingedly connected to each other in the same manner, as the side panels **22*a*, 22*b*, 22*c* and 22*d* of structure 20. As with structure 20, the structure 180 has an upper fabric 190 and a lower fabric 192**.

However, to further illustrate that the panels can be provided in different shapes and sizes, the top edge 194 of the rear panel 186 extends above the upper fabric 190, even though the top edges 196, 198, 200 of the other side panels 188, 182, 184, respectively, are connected to the upper fabric 190. Two openings 202 are provided in the rear panel 186 above the upper fabric 190 to allow the structure 180 to be suspended at a wall. Alternatively, the openings 202 allow the individual to grip or otherwise lift the structure 180. In addition, a handle 204 may also be provided along the top edge 194 for handling or gripping the structure 180.

As with structure 130, the panels 182, 184, 186, 188, and the fabrics 190, 192 are preferably provided in a mesh material so that the interior of the structure 180 can be viewed from the outside. The side panels 182, 184, 186, 188 preferably do not have any openings, while one or more openings 206 is provided in the upper fabric 190. The opening 206 provides access to the interior of the structure 180.

Figure 12:
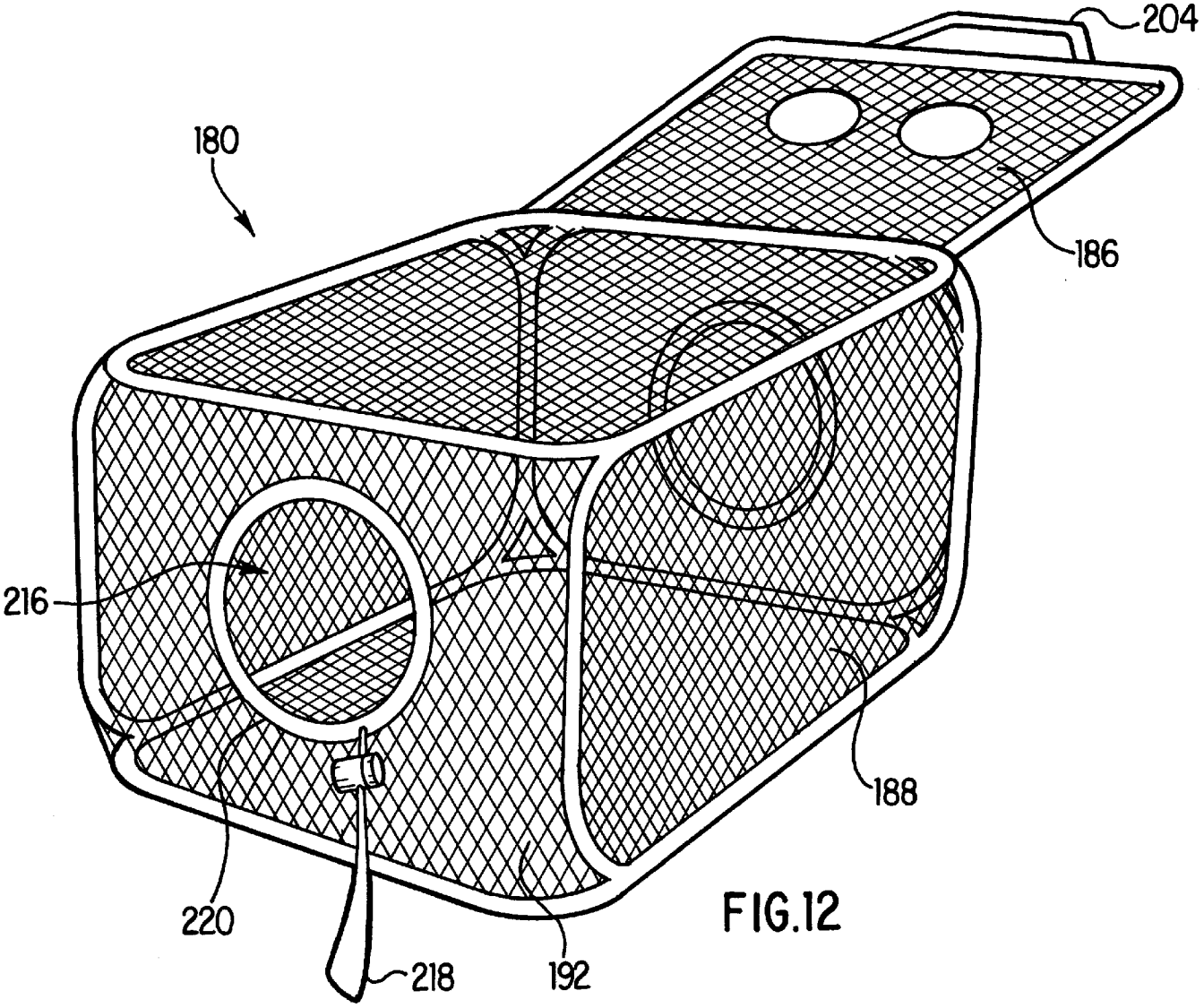
FIG. 12 is a bottom perspective view of the structure of FIG. 10.

In addition, the bottom fabric 192 is modified, as shown in FIG. 12, to provide an opening 216 whose size can be adjusted by a drawstring 218. In particular, a drawstring 218 is housed inside a circular sleeve 220 that defines the opening 216. Pulling on the drawstring 218 will cause the sleeve 220 to shrink in size, thereby closing the opening 216 and preventing the contents stored inside the structure 180 from being removed through the opening 216. In contrast, releasing the drawstring 218 will cause the opening 216 to expand, thereby allowing the contents stored inside the structure 180 to be removed through the opening 216.

The structure 180 can be used, for example, as a laundry container to store dirty clothing 208. The clothing 208 can be placed through the opening 206 and stored in the interior of the structure 180. Alternatively, clothing items 208 can be tossed from a distance at the opening 206. In this regard, the opening 206 can be provided large enough to allow a user to reach inside the interior of the structure 180 to select and retrieve specific items of clothing 208. The drawstring 218 at the lower fabric 192 can also be loosened to remove clothing items 208.

The structure 180 can be used conveniently by families who travel or move about frequently. For example, the structure 180 can be used as laundry hamper at home, and when the family goes on a vacation, the structure 180 can be folded and collapsed in the manner described in FIGS. 8A–8E to reduce its size so that it can be conveniently taken along and used by the family during its vacation. At the vacation home or hotel, the structure 180 can be expanded for use, and then folded and collapsed when the family returns home.

The structure 180 in FIG. 10 can also be used as a waste paper basket, as shown in FIG. 11. FIG. 11 illustrates the structure 180*a*, which is essentially the same as structure 180 except that it has been modified for more convenient use as a waste paper basket. As a result, the elements in FIG. 11 that are common to those in FIG. 10 are designated with the same numerals, but with an "a" added to the numeral designations. The structure 180*a* further includes a funnel or guide 210 that is connected to the mouth of the opening 206*a*, and which suspends therefrom into the interior of the structure 180*a*. The guide 210 is optional, but where provided, operates to guide the paper 212 or other item through the opening 206*a* into the interior of the structure 180*a*.

In addition, although the upper and lower fabrics 156, 158, 190, 192, 190*a* and 192*a* are described as being meshed fabrics, it is also possible to provide a surrounding frame member for these upper and lower fabrics 156, 158, 190, 192, 190*a* and 192*a* so that they become upper panels and lower panels.

Thus, the embodiments of FIGS. 9–11 provide collapsible structures which provide useful and convenient storage for a number of different items, while providing a degree of fun and entertainment. The top openings 160, 206 and 206*a*, and the bottom openings 216, provide access to the interior of the structures 130, 180 and 180*a*. The shapes and sizes of the panels and the structures can be varied or combined. In addition, a plurality of these individual structures can be combined in the manner described above. For example, a plurality of structures 130 in FIG. 9 can be combined so that different types of balls are stored in each of the plurality of these structures 130. Similarly, a plurality of structures 180 in FIG. 10 can be combined so that different types of clothing are stored each of the plurality of these structures 180. These structures 130, 180 can be combined using detachable means, such as hooks, fasteners, and Velcro, for example. These embodiments further illustrate the versatility of the basic module 20 of the present invention, in that this basic module 20 can be used to form the basis for numerous structures that offer an unlimited variety of utility, entertainment and other purposes.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure adapted to be supported on a surface and comprising:

at least three foldable frame members, each having a folded and an unfolded orientation, the frame members defining an enclosed space and a base that has a size;

a fabric material substantially covering each frame member to form a panel for each frame member when the frame member is in the unfolded orientation, the fabric assuming the unfolded orientation of its associated frame member; and a top fabric connected to the panels and extending therebetween, the top fabric having an opening communicating with the enclosed space, the top fabric having a size that is at least equal to the size of the base.

2. The structure of claim 1, wherein each panel further comprises a top edge, and wherein the top fabric is attached to the top edges of the panels.

3. The structure of claim 1, wherein each panel has a bottom edge, and wherein the structure further includes a bottom fabric connected to the bottom edges of the panels and extending therebetween.

4. The structure of claim 1, wherein each panel is devoid of any openings so that the structure can operate as a container for objects.

5. The structure of claim 1, wherein the opening in the top fabric is sized and configured to allow objects to pass therethrough.

6. The structure of claim 1, wherein each panel comprises a frame retaining sleeve for retaining one of the frame members, and the frame retaining sleeves of adjacent panels are stitched together to form a hinged connection.

7. The structure of claim 1, wherein the structure has four panels.

8. A collapsible structure adapted to be supported on a surface and comprising:

at least three foldable frame members, each having a folded and an unfolded orientation, the frame members defining an enclosed space;

a fabric material substantially covering each frame member to form a panel for each frame member when the frame member is in the unfolded orientation, the fabric assuming the unfolded orientation of its associated frame member;

each panel having a straight top side, with the top sides of each panel defining a top opening; and a top fabric connected to the top sides of the panels and covering the top opening, the top fabric having an opening communicating with the enclosed space.

9. The structure of claim 8, wherein the opening in the top fabric is sized and configured to allow objects to pass therethrough.

10. The structure of claim 8, wherein each panel comprises a frame retaining sleeve for retaining one of the frame members, and the frame retaining sleeves of adjacent panels are stitched together to form a hinged connection.

11. The structure of claim 8, wherein the structure has four panels.

* * * * *